United States Patent [19]

Sharps, Jr.

[11] Patent Number: 4,930,905

[45] Date of Patent: Jun. 5, 1990

[54] THERMOPLASTIC BAG WITH INTEGRAL DRAW STRIP AND METHOD OF MANUFACTURE

[75] Inventor: Gordon V. Sharps, Jr., Fairport, N.Y.

[73] Assignee: Mobil Oil Corporation, New York, N.Y.

[21] Appl. No.: 234,657

[22] Filed: Aug. 22, 1988

[51] Int. Cl.[5] ..... B65D 33/28

[52] U.S. Cl. ..... 383/75; 383/76

[58] Field of Search ..... 383/75, 72, 71, 74, 383/76, 77

[56] References Cited

U.S. PATENT DOCUMENTS

| | | | |
|---|---|---|---|
| 3,029,583 | 11/1959 | Piazzi | 383/75 |
| 3,285,309 | 11/1966 | Northcott | 383/76 |
| 3,414,032 | 3/1967 | Jortikka | 383/75 |
| 3,506,048 | 4/1970 | Jortikka | 383/75 |
| 3,738,568 | 6/1973 | Ruda | 229/62 |
| 3,752,388 | 8/1973 | Lynch | 383/76 |
| 3,982,687 | 9/1976 | Auer et al. | 229/62 |
| 4,624,654 | 11/1986 | Boyd | 493/225 |
| 4,628,536 | 12/1986 | Herrington | 383/75 |

FOREIGN PATENT DOCUMENTS

| | | | |
|---|---|---|---|
| 2215612 | 10/1973 | Fed. Rep. of Germany | 383/75 |

*Primary Examiner*—Willis Little

*Attorney, Agent, or Firm*—Alexander J. McKillop; Charles J. Speciale; James P. O'Sullivan, Sr.

[57] ABSTRACT

A thermoplastic bag with a separably integral draw strip which is extruded concurrently with the thermoplastic film of the bag body and has a thicker dimension than the thermoplastic film. The draw strip is confined within a tubular channel defining an open mouth for the bag.

6 Claims, 2 Drawing Sheets

THERMOPLASTIC BAG WITH INTEGRAL DRAW STRIP AND METHOD OF MANUFACTURE

BACKGROUND OF THE INVENTION

This invention relates to the manufacture of flexible bags and particularly to the manufacture of draw tape bags from thermoplastic films wherein the draw tape is in the form of a thickened strip of thermoplastic material separably integral with the bag body.

Bags made of plastic film such as thin polyethylene film have been used in various sizes. Small bags are used in the packaging of sandwiches and the like; larger bags are used as shopping bags and even larger bags are used for containing trash. The present invention is particularly related to the small or medium size bags where the loading of the bag is not particularly heavy but a tight draw closure is desired.

A particularly advantageous closure for such bags includes a draw band or tape constructed from the same polyethylene material. Draw tape bags of this type have been known for several years and are described in various patents such as, for example, U.S. Pat. No. 3,029,583—Piazzi and U.S. Pat. No. 3,412,032—Jortikka which are examples of draw tape bags of the moderate size shopping bag type. Bags of this type are formed by two pliable plastic sheets joined to one another on three sides and open at a fourth. A tubular hem is provided at the open end of each sheet and contains a pliable thermoplastic strip. A hole intermediate the ends of each hem exposes the strip in the hems allowing them to be pulled through the openings and used as a handle while simultaneously closing the open mouth of the bag. A similar type bag is disclosed in U.S. Pat. No. 4,624,654 Boyd et al. In the foregoing patents the draw tapes are separate from the plastic bags. U.S. Pat. No. 3,738,568—Ruda discloses a plastic bag with a draw band separably integral with the bag body and U.S. Pat. No. 3,982,687—Auer et al discloses a thermoplastic bag where the detachable strap is a looped portion of one sidewall of the bag. A hemless draw band bag with the draw band being a folded over double-ply portion of the bag body partially separated from the body with relatively minute tear points connecting it to the body is disclosed in application Ser. No. 947,717, filed Dec. 30, 1986 by Paul V. Osborn entitled "Draw Band Bag" and assigned to the same assignee as the present invention.

It is an object of the present invention to provide a thermoplastic bag with an integral draw strip which is extruded concurrently with the thermoplastic film of the bag body and has a thicker dimension than the thermoplastic film.

SUMMARY OF THE INVENTION

In accordance with the present invention, there is provided a method of forming a thermoplastic bag with a separably integral draw strip. The method comprises the steps of extruding a tube of thermoplastic film having a thicker strip of thermoplastic material separably integral with the tube and extending longitudinally of the tube. The tube is flattened to provide opposed layers of the film. The flattened tube is s it along one side of the strip to provide a bag opening. Holes are cut in the layers of film in the flattened tube adjacent the strip at predetermined intervals related to the predetermined width of the bag, the strip is folded inwardly between the layers of film of the flattened tube to form a hem in one of the layers enclosing the strip with the strip in alignment with the holes. The hem is sealed to maintain the strip within the hem and the flattened tube is transversely sealed and severed along with the hem at predetermined intervals corresponding to the predetermined width of the bag. In accordance with a further aspect of the invention a second hem is formed along the slit edge in the other one of the layers of film to enclose a second separably integral strip and the second hem is sealed while maintaining the holes in the second hem in alignment with the strip and the holes in the first-named hem.

In accordance with another aspect of the invention there is provided a thermoplastic bag with separably integral draw strip. The bag comprises a front wall and back wall of opposed layers of thermoplastic sheet material joined to each other along the side and bottom edges of the bag. At least one tubular channel extends along opposed transverse top edges of the front wall and back wall. The top edges of the walls define an open mouth for the bag and the front wall and back wall have aligned openings therein adjacent the top edges and intermediate the side edges of the bag. The draw strip is confined within the tubular channel and secured at the opposite ends thereof to the side edges of the bag. The draw strip is separably integral with the bag and is joined to the tubular channel by a narrow thickness of the bag material extending lengthwise of the channel, the draw strip having a thickness greater than the thickness of the bag material. The draw strip is confined within the channel in alignment with the openings through the front and back walls. In accordance with a further aspect of the invention a pair of tubular channels extend along the opposed transverse top edges of the front and back walls, each channel containing a separably integral draw strip.

In accordance with another aspect of the invention there is provided in a reclosable bag comprising a bottom end, side-walls, and a top end, formed from heat-sealable material, the improvement comprising a detachable strip wherein the strip is an integral thickened portion of one side wall and connected thereto by a thin section of the heat-sealable material, the strip being heat sealed to the opposite sides of the bag at the opposite ends of the strip, the strip extending laterally substantially across one full side dimension of the one side wall at the top end, the strip being confined within a tubular channel formed by the one side wall, and openings are provided in both side walls adjacent the middle of the strip for pulling the strip through the side walls to close the top of the bag and provide a carrying handle.

The foregoing and other objects, features and advantages of the invention will be better understood from the following more detailed description and appended claims.

DESCRIPTION OF THE PREFERRED EMBODIMENT

The plastic draw tape bags of the present invention may be made from either high density polyethylene (HDPE) or from linear low density polyethylene (LLDP) or equivalent plastic materials. In the preferred form of the invention the bags are formed from a tube of polyethylene which is oriented in the direction of extrusion. Such materials for plastic bags are disclosed in U.S. Pat. No. 4,558,463—Boyd. Apparatus suitable for manufacturing draw tape bags of the present invention is disclosed in U.S. Pat. No. 4,624,654—Boyd et al and the disclosure therein is incorporated herein by reference thereto.

Figure 1:
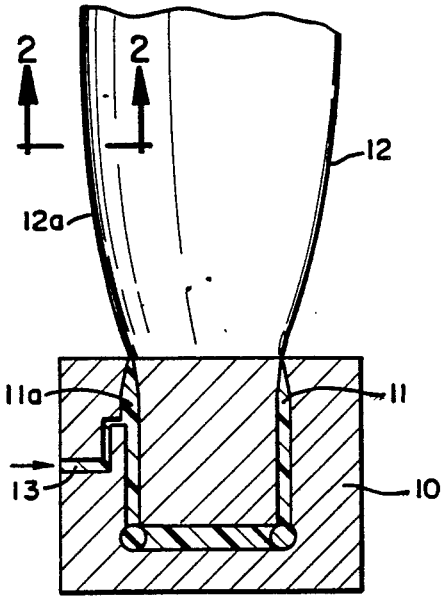
FIG. 1 is a sectional view of a circular die for extruding a tube of thermoplastic film having a separably integral draw strip for performing the method of the present invention.
Figure 2:
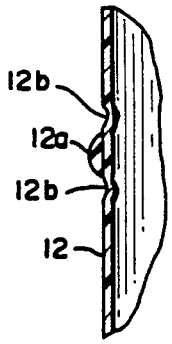
FIG. 2 is a sectional view taken along the lines 2—2 in FIG. 1 through the side wall of the thermoplastic tube and the extruded strip.

In accordance with the method of the present invention a narrow strip of HDPE, or equivalent, is applied on a base film of HDPE at the appropriate location on a blown film bubble or tube. This is accomplished as shown in FIG. 1 by extruding a narrow stream of HDPE into a common annular conduit prior to the die lip exit. Referring to FIG. 1, there is shown in cross section a circular die 10 which is adapted to be supplied with heated plastic from an extruder assembly, not shown, similar to the extruder assembly shown in the aforesaid U.S. Pat. No. 4,624,654. The die 10 is provided with an annular conduit 11 which is adapted to form the heated plastic into a continuous tubular column 12 of extruded thermoplastic film. A narrow strip 12*a* of HDPE on the base film or tube is accomplished by extruding a narrow stream of HDPE into the common annular conduit 11 prior to the die lip exit. This is illustrated in FIG. 1 by the passage 13 which communicates with the annular conduit at 11*a* and prior to the die lip exit. If greater high density orientation is desired, this joining can be done outside the die with the gap selected so that a significantly higher machine direction draw down is effected of the high density tape or strip 12*a*. The base film and the strip 12*a* need not be the same thermoplastic material. As may be seen in FIG. 2 the cross-section of the strip 12*a* is thicker than the cross-section of the base film 12. During the blown film orientation process, the base film material immediately adjacent to the tape 12*a* thins down preferentially due to greater mass/temperature near the tape 12*a*. This thinning at 12*b* adjacent both sides of the strip 12*a* allows "easy tear" of the tape 12*a* from the base film 12 but maintains integrity of the film during processing of the thermoplastic bags. The thermoplastic tube of material 12 is then slit to make a bag opening in the longitudinal or machine direction and holes are cut in the film 12 at the appropriate position and spacing intervals. This is preferably accomplished while the material 12 is still in the form of a tube and the tube is flattened and slit longitudinally along one of the thin sections 12*b*.

Figure 3:
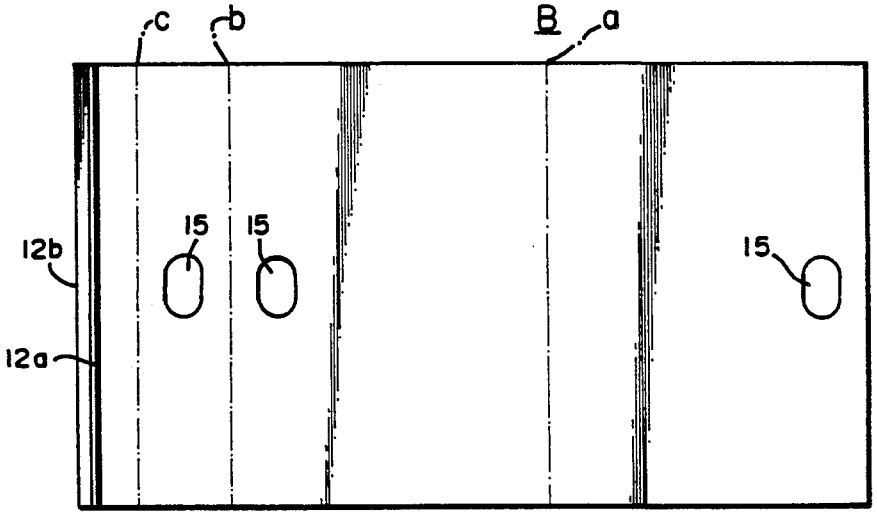
FIG. 3 is a plan view of the thermoplastic film with separably integral draw strip prior to being formed into a thermoplastic bag in accordance with the present invention.

For purposes of explanation there is illustrated in FIG. 3 a blank B for forming one of the individual bags. The blank is made of the thermoplastic base film 12 having the thickened strip 12*a* running along the left hand end of the blank. This end will correspond to the top end of the finished bag. The blank B in FIG. 3 is provided with a plurality of holes 15 which are disposed intermediate the side edges of the blank B. These holes 15 are adapted to be in alignment in the finished bag and in order that the holes may be cut concurrently the blank B is adapted to be folded inwardly along the fold lines a and b. Thus it will be seen that the layers of the film 12 will be superimposed and the holes 15 will be in alignment so that they may be cut concurrently. It is also to be understood that the holes 15 ca be cut individually when the blank B is flat as shown in FIG. 3. Also the middle hole 15 shown in FIG. 3 may be omitted if desired as the draw strip 12*a* is pulled from the opposite side of the bag. After the holes 15 have been cut in the film, a cuff or hem is formed in the left hand end of the blank by folding the film inwardly along the fold line c into the position shown in FIG. 4. As may be seen in FIG. 4 the draw strip 12*a* is in alignment with the openings 15 in the opposed layers of the thermoplastic film and the draw strip 12*a* is confined within a hem formed by the thermoplastic material adjacent the top end of the bag. A heat seal is formed along the length of the draw strip 12*a* at 17 to seal the hem and enclose the draw strip 12*a* within the hem.

Figure 4:
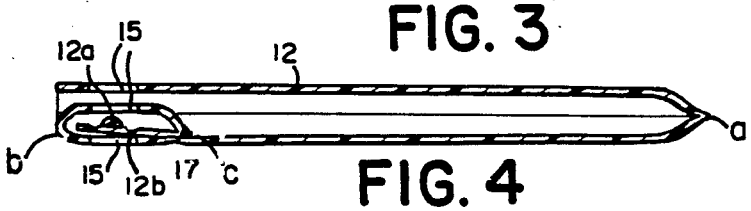
FIG. 4 is a sectional view through a thermoplastic bag manufactured in accordance with the present invention.

While the foregoing explanation has been made in connection with a single bag blank B it is to be understood that in production the folding operations and punching operations would be performed in a running length or web of thermoplastic film prior to transversely sealing and cutting the web into discrete bags. After the machine direction seal 17 has been completed in the edge of the hem as shown in FIG. 4, the bags are then formed in a conventional manner on side seal bag making equipment such for example as disclosed in the aforesaid U.S. Pat. 4,624,654.

Figure 5:
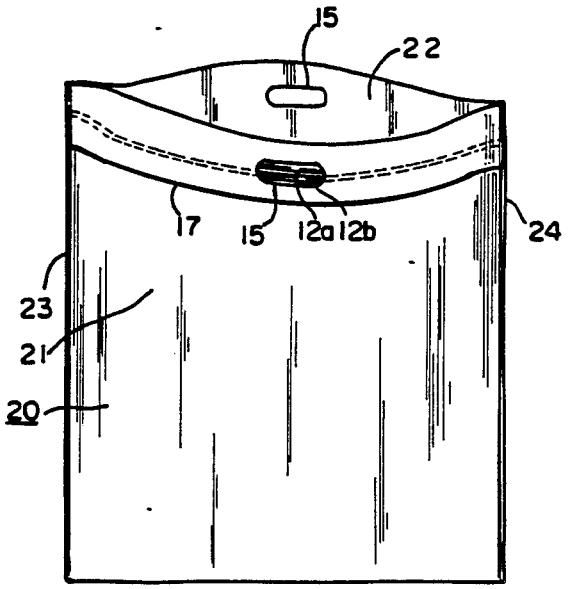
FIG. 5 is a perspective view of a thermoplastic bag manufactured in accordance with the present invention.

A completed bag 20 manufactured in accordance with the present invention is illustrated in FIG. 5. As shown in FIG. 5 the hem containing the draw strip 12*a* is formed in the front panel 21 of the bag with the hem being sealed at 17. The draw strip 12*a* is in alignment with the holes 15 in the hem and also the hole 15 in the back panel 22 of the bag. The front and back panels 21 and 22 have been sealed together along the side edges at 23 and 24 to complete the bag 20. To close the bag 20, the draw tape or strip 12*a* is pulled from the hem, breaking or tearing at the thinned interface 12*b* shown in FIG. 4. The draw tape 12*a* is pulled from the hem hole 15 and inserted into the opposite hole 15 in the back panel 22. Pulling the tape 12*a* closes the bag 20 partially. Complete liquid tight closure is made by looping the tape 12*a* around the neck of the bag 20.

Figure 6:
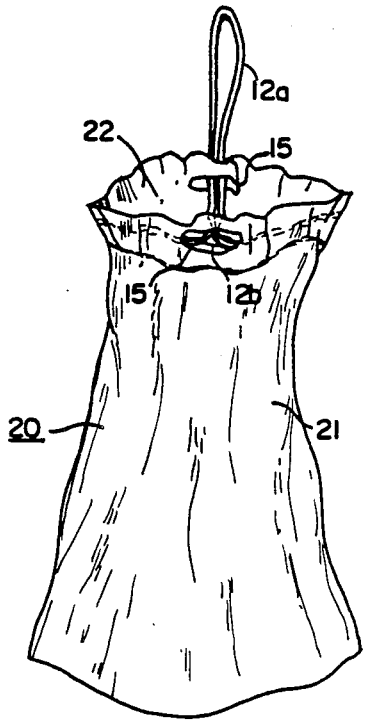
FIG. 6 is a perspective view of the thermoplastic bag shown in FIG. 5 with the separably integral draw strip pulled through the openings in the top of the bag.
Figure 7:
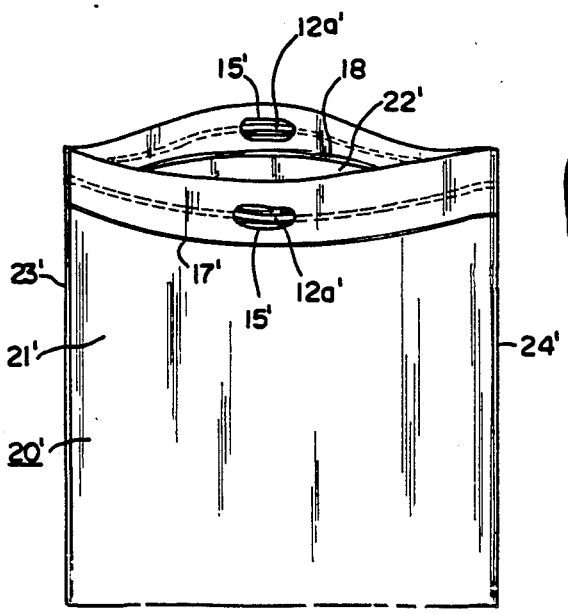
FIG. 7 is a perspective view of a modification of the thermoplastic bag shown in FIG. 5 with a pair of separably integral draw strips and embodying the present invention.
Figure 8:
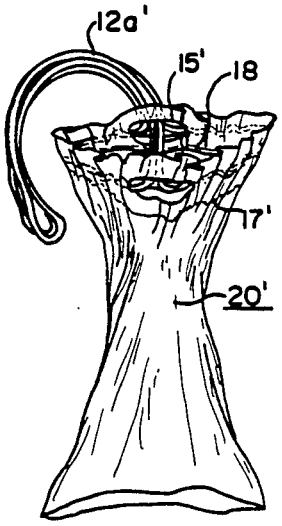
FIG. 8 is a perspective view of the thermoplastic bag shown in FIG. 7 with the pair of separably integral draw strips pulled through the openings at the top of the bag.

Referring to FIG. 7 there is illustrated a modification of a bag manufactured in accordance with the present invention. The bag 20', illustrated in FIG. 7 is similar to the bag 20 in FIG. 5 with the exception that there is provided a second hem at the top end of the back wall 22'. This hem is provided with a transverse seal 18 and contains a second separably integral draw tape 12'*a*. The other parts of the bag 20' in FIG. 7 have been identified with reference characters corresponding to the bag 20 in FIG. 5 but with the addition of a prime. FIG. 8 is similar to FIG. 6 and shows the bag 20' with the two draw tapes 12'a pulled through the openings 15' to close the bag. Pulling the tape 12'a closes the bag 20' partially and complete liquid tight closure is made by looping the tape 12'a around the neck of bag 20'. It will be understood that both separably integral draw tapes 12'a would be extruded with the base film in similar manner to that described above in connection with the single strip 12a in FIGS. 1–3. The tube of film would be slit along one of the thin sections 12b between a pair of draw strips 12a so that a draw strip 12a would be located at each end of the blank B.

It is to be understood that the invention may be carried out for making bags of material other than the specific ones mentioned above. While there has been described a preferred embodiment of the invention, it will be understood that further modifications may be made without departing from the spirit and scope of the invention as set forth in the appended claims.

What is claimed is:

1. Method of forming a thermoplastic bag with separably integral draw strip comprising the steps of:

extruding a tube of thermoplastic film having at least one thicker commonly extruded strip of thermoplastic material separably integral with the tube and extending longitudinally of the tube, flattening the tube to provide opposed layers of the film, slitting the flattened tube along one side of the strip to provide a bag opening, cutting holes in the layers of film of the flattened tube adjacent the strip at predetermined intervals related to the predetermined width of the bag, folding the strip inwardly between the layers of film of the flattened tube to form a hem in one of the layers enclosing the strip with the strip in alignment with the holes, sealing the hem to maintain the strip within the hem, and transversely sealing and severing the hem and flattened tube at predetermined intervals corresponding to the predetermined width of the bag.

2. A method according to claim 1 comprising the steps of:

commonly extruding a second separably integral thicker strip of thermoplastic material with the tube of film, forming a second hem in the other one of the layers of film to enclose the second strip, sealing the second hem to maintain the second strip therein and maintaining the holes in the second hem in alignment with the strip and the holes in the first-named hem.

3. A thermoplastic bag with integral draw strip which comprises:

a front wall and back wall of opposed layers of thermoplastic sheet material joined to each other along the side and bottom edges of the bag;

at least one tubular channel extending along opposed transverse top edges of said front wall and said back wall, said top edges of said wall 3 defining an open mouth for the bag, said front wall and said back wall having aligned openings therein adjacent the top edges and intermediate the side edges of the bag; and a draw strip confined within said tubular channel and secured at the opposite ends thereof to the side edges of the bag, said draw strip being a commonly extruded strip separably integral with the bag and being joined to the tubular channel by a narrow solid thickness of the bag material extending lengthwise of the channel, said draw strip having a thickness greater than the thickness of the bag material.

4. A draw strip bag according to claim 3 wherein said draw strip confined within the tubular channel is in alignment with the openings through the front and back walls.

5. A draw strip bag according to claim 4 wherein a pair of tubular channels extend along the opposed transverse top edges of the front and back walls and each of said channels contains a separably integral draw strip.

6. In a reclosable bag comprising a bottom end, side wall, and a top end, formed from heat-sealable material, the improvement comprising a detachable strip, wherein said strip is an integral thickened portion of one sidewall and connected thereto by a thin section of the heat-sealable material, said strip being heat sealed to the opposite sides of the bag at the opposite ends of the strip, said strip extending laterally substantially across one full side dimension of said one sidewall at the top end, said strip being confined within a tubular channel formed said one sidewall, and openings are provided in both sidewalls adjacent the middle of the strip for pulling the strip through the sidewalls to close the top of the bag and provide a carrying handle.

* * * * *